United States Patent [19]

Esposito

[11] Patent Number: 4,745,723

[45] Date of Patent: May 24, 1988

[54] GLAZING GASKET AND RELATED SUPPORTING STRUCTURE AND METHOD

[75] Inventor: Joseph Esposito, Holbrook, N.Y.

[73] Assignee: Four Seasons Solar Products Corporation, Holbrook, N.Y.

[21] Appl. No.: 25,405

[22] Filed: Mar. 13, 1987

[51] Int. Cl.[4] ..... E04D 1/36

[52] U.S. Cl. ..... 52/464; 52/461; 52/468

[58] Field of Search ..... 52/461, 464, 468, 459, 52/397, 93, 173 R

[56] References Cited

U.S. PATENT DOCUMENTS

| | | | |
|---|---|---|---|
| 697,747 | 4/1902 | Pierson | 52/461 X |
| 2,976,969 | 3/1961 | Gillespie | 52/464 |
| 3,071,215 | 1/1963 | Gall | 52/461 X |
| 4,114,330 | 9/1978 | Sukolics | 52/461 X |
| 4,648,231 | 3/1987 | Laroche | 52/468 X |
| 4,671,027 | 6/1987 | Esposito | 52/86 |

FOREIGN PATENT DOCUMENTS

| | | | |
|---|---|---|---|
| 2350069 | 7/1974 | Fed. Rep. of Germany | 52/397 |
| 553915 | 1/1957 | Italy | 52/397 |

*Primary Examiner*—David A. Scherbel
*Assistant Examiner*—Creighton Smith
*Attorney, Agent, or Firm*—Roberts, Spiecens & Cohen

[57] ABSTRACT

In a solarium construction, glazing is supported on glazing bars to which the glazing is clamped by means of gasket strips. The glazing bars and strips, which are interconnected are divided into complementary mirror image parts. The force which is used to connect the glazing bar parts together causes the strip parts to be forced together and this displaces the strip parts more tightly against the glazing. This enables a force which is applied within the solarium to be effective externally to fasten the glazing in position.

26 Claims, 3 Drawing Sheets

GLAZING GASKET AND RELATED SUPPORTING STRUCTURE AND METHOD

FIELD OF INVENTION

This invention relates to glazing supports and more particularly to glazing gaskets and related extrusions as well as an arrangement to enable the same to interact. The invention also applies to related methods for the construction of glazing arrangements.

BACKGROUND

Different types of solar greenhouse and solarium structures are shown in various patents including, for example, U.S. Pat. Nos. 4,438,680 and 4,598,752. Such structures are also illustrated in a brochure entitled "FOUR SEASONS SOLAR PASSIVE GREENHOUSES AND SOLARIUM STRUCTURES" published by Four Seasons Solar Products Corporation of Holbrook, N.Y. These solar greenhouses involve the utilization of frameworks made of extrusions and including glazing bars as well as muntins and the like. The framework supports glazing which defines an interior enclosed space which is separated by the glazing from the ambient atmosphere. In co-pending application Ser. No. 885,402, filed July 14, 1986 (the contents of which are embodied herein as set forth fully in this text) is disclosed a modular technique for assembling solariums and greenhouses according to which technique separate bays are aligned in adjacent and abutting posture and are connected together to form the aforesaid framework and glazing in situ. Essential to the assembling of the glazing and framework is the utilization of resilient glazing gaskets and the like which hold the glazing in relatively fixed position against the associated framework in such a manner as to allow a modest yielding of the glazing in order to avoid application of forces to the glazing which might cause breakage and cracking.

There are a wide variety of glazing gaskets which have been employed for the purpose of affixing glazing to a supporting framework or the like. Some of these glazing gaskets are simple resilient strips or bodies which are slid into position between the glazing and framework in order to serve somewhat like a wedge. More sophisticated glazing gaskets are commercially available such as those which are offered by Maloney Position Products Co. of Houston, Tex. and the standard products Co. of Port Clinton, Ohio. The Maloney gaskets as well as the Standard Products gaskets employ a structure constituting a preformed elastomeric mechanical seal which is adapted to attach a panel such as a piece of glass to a supporting framework of metal, concrete or other constructional material. These gaskets are so formed that, in order to attain the sealing pressures which are required to secure panels to frames and provide a seal between the same, they are made in two parts. These two parts include the gasket itself and a separate locking strip sometimes known as a zipper. The locking strip is inserted progressively with a special tool into a groove that is provided in the gasket. This puts the entire gasket under sufficient compression to produce the required sealing pressure. It will be noted that in order to install glazing gaskets of the aforenoted type that the entire operation of installation and adjustment takes place on that side of the glazing from which the installation of the gasket takes place. This is not always convenient and sometimes is rather dangerous or sometimes impossible.

SUMMARY OF INVENTION

It is an object of the invention to provide an improved glazing gasket as well as an improved constructional feature involving the utilization of a solarium framework or the like in combination with an improved glazing gasket.

It is another object of the invention to provide an improved solarium structure in which the adjustment of the engagement between a glazing gasket and the associated glazing is controlled from the interior of the solarium or greenhouse structure.

Yet another object of the invention is to provide an improved glazing gasket preferably in strip form which is readily applied to a glazing installation while permitting adjustment of the engagement between the gasket and the glazing in a very convenient manner.

In achieving the above and other of the objects of the invention, there is contemplated by way of example, and as will be explained in greater detail hereinbelow, a glazing structure which comprises first and second glazing support means adapted for being brought together to constitute a glazing support, first and second glazing entrapment means (such as a glazing gasket) mounted respectively on the aforesaid first and second support means and defining therewith first and second glazing receptacles, first and second glazing members adapted for edgewise engagement in the first and second receptacles, and fastening means to hold the first and second support means together. In further accordance with the invention, the aforesaid first and second entrapment means include respective displaceable contact portions and mutually engageable portions which contact each other as the first and second support means are brought together. The glazing contact portions as will be explained in greater detail hereinbelow are forced against respective of the glazing members in response to a mutual engagement of the mutually engageable portions to lock the glazing members in the receptacles.

According to other features of the invention, the first and second glazing support means are adapted to abut along a plane and the mutually engageable portions tend to extend across this plane, but are positioned to engage with one another and thereby be displaced. According to a further feature of the invention, the entrapment means are of a relatively resilient material and the support means are of a relatively rigid material such as an aluminum extrusion. Further features of the invention include that the support means and entrapment means are longitudinally extended members and that the extended members may include curved portions. Still further, it will be noted in the description which follows hereinbelow that the glazing members define an inner space separated by the glazing member from ambient atmosphere, the fastening means being located in the inner space and the glazing contact portions being located in the ambient atmosphere.

As will be described in greater detail hereinbelow, the glazing entrapment means include removable sections to enable a weakening of the pressure exerted by the glazing contact portions against the glazing members to permit removal of the glazing members. Still another feature involves that the glazing entrapment means include base portions supporting the glazing contact portions and mutually engageable portions. These base portions and glazing support means respectively include and are provided with matching and inter-engaged enlarged portions and receptacles.

Still further features of the invention include that the aforesaid base portions are further provided with respective slots and the glazing support means include extensions extending into these slots. Moreover, it will be seen hereinafter that the glazing entrapment means are provided with grooves between the base portions and the mutually engageable portions to enable the latter to pivot on the base portions. Yet a further feature is that the mutually engageable portions are angularly related to the aforementioned plane and to each other.

It is to be noted from the following description that the fastening means include a nut and bolt arrangement, the bolt extending through the glazing support means and being engaged by the nut. It should also be noted that the support means are provided with tracks adopted for the peripheral engagement of shades. Still further to be noted is the feature whereby the support means include shoulders opposing the glazing contact portions in order to receive the glazing members therebetween.

Viewed from another aspect, the invention provides a solarium construction defining an inner space separated from ambient atmosphere and comprising a framework including glazing bars, glazing sections supported on these bars, first means on the bars at least in part externally of the glazing to trap the glazing against the bars, and second means inside of the construction and operatively associated with said bars to tighten the first means against the glazing.

Further viewed according to this aspect of the invention, the novel arrangement provides that at least one of the aforesaid bars includes complementary sections with the second means being employed to fasten the complementary sections together, said first means being responsive to the fastening of the complementary sections for being tightened against the glazing. Still further it should be noted that the first means mentioned hereinabove includes complementary sections in partially abutting relationship constituting a water-proof seal between adjacent glazing sections.

In the aforesaid solarium construction, it will be noted that the complementary sections of the first means are relatively vertically arranged strips and that the glazing, bars and vertically arranged strips include aligned curved sections.

Viewed from the aspect of the glazing gasket alone, it should be noted in accordance with the invention that such gasket comprises first and second angularly-related sections cooperatively including a narrow connecting section at which the second section is pivotal on the first section and that the aforesaid second section includes first and second parts protruding in opposite directions generally transversely of the first section. It will be noted that the first part has a ribbed end face remote from the narrow section and that the second part has a ribbed lateral face adapted to engage against the glazing. It will furthermore be noted that the sections constitute a monolithic resilient strip provided with a V-shaped groove adjacent the narrow section to enhance the pivot-like relationship between the sections. According to the invention, the first section further includes an enlarged base adapted to be engaged in a receptacle in a supporting structure and an appendage defining a slot adapted to receive a section of the supporting structure.

The invention also relates to a method as will be explained in greater detail hereinbelow. This method is a method of mounting glazing in a solarium or the like comprising supporting the glazing against a glazing bar to define an inner solarium space, clamping the glazing to the glazing bar with a gasket, applying a force to the glazing bar within the inner space and diverting at least a part of the force to the gasket to force the gasket more tightly against the glazing. More particularly, this involves forming the glazing bar in complementary sections and fastening the sections together with the aforesaid force. The method furthermore comprises clamping the glazing to the glazing bar with a force derived from the force used to fasten the sections together.

The above and other objects, features and advantages of the invention will be found in the Detailed Description which follows hereinbelow as illustrated in the accompanying drawing.

DETAILED DESCRIPTION

Figure 1:
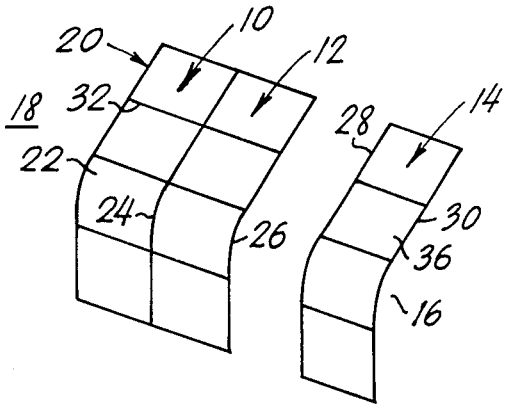
FIG. 1 is a partially exploded diagrammatic and perspective view of a plurality of glazing bays constituting the environment for the glazing gasket of the invention.

In FIG. 1 is illustrated a plurality of bays or modules 10, 12 and 14. These bays or modules are adapted for being connected together to constitute a major portion of a greenhouse or solarium construction defining an interior space 16 separated from ambient atmosphere 18 by means of the glazing incorporated into the respective modules.

The construction consists generally of a framework 20 involving glazing bar or glazing bar sections indicated at 22, 24, 26, 28 and 30. Transversely thereof are arranged a plurality of muntins such as indicated at 32. Bars 22 and 24 are complete bars, whereas reference characters 26 and 28 illustrate glazing bar sections adapted to be connected together to constitute a glazing bar as will become more apparent hereinbelow. Also included in the structure are glazing panels such as indicated at 36. Glazing panels such as indicated may be fabricated of glass or plastic and may be tempered or of insulated construction or the like.

Figure 2:
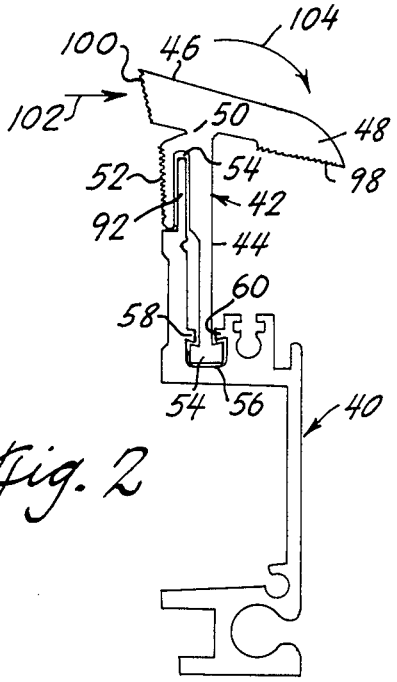
FIG. 2 is a sectional view of a complementary half of a glazing bar and glazing gasket combination provided in accordance with the invention.
Figure 3:
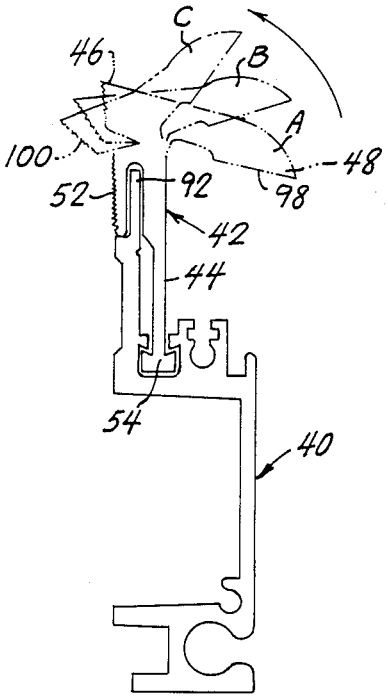
FIG. 3 illustrates the utilization of the glazing gasket of the invention.
Figure 4:
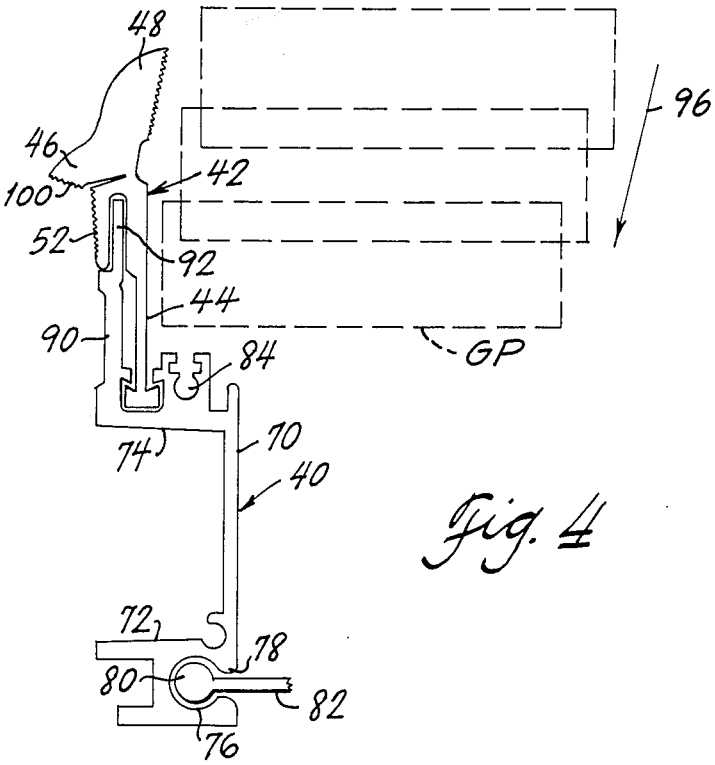
FIG. 4 corresponds to FIGS. 2 and 3 and shows the installation of glazing with respect to a glazing bar section and employing a glazing gasket section in accordance with the invention.

One of the problems that the invention is concerned with is that a worker standing in the enclosed space 16 should be able with great convenience to exert control over the contact between a glazing gasket and the associated glazing panel without requiring assistance from a party located outside of the solarium construction(or in other words located in the ambient atmosphere 18). The solution to this problem is provided by the glazing bar construction and glazing seal construction provided for in accordance with the invention and illustrated by way of example in FIGS. 2–4. FIG. 2 shows the glazing seal in relaxed condition prior to insertion of a glazing panel. FIG. 3 illustrates the pivotal movement undertaken by a portion of the glazing gasket in accordance with the invention. FIG. 4 shows the glazing gasket extremity withdrawn to permit the insertion of a glazing panel, all in accordance with the invention.

In FIGS. 2–4 are illustrated a glazing bar section 40 and a glazing seal or gasket 42. The glazing gasket includes a base portion 44 and parts 46 and 48 which extend in opposite directions and generally transversely of the base portion 44 to perform functions which will be indicated in greater detail hereinbelow. Sections 46 and 48 are sections angularly related to associated section 44.

Parts 46 and 48 which constitute the upper section of the gasket are connected to the base portion 44 at a relatively narrow section 50 which constitutes generally a pivot point for movement of the parts 46 and 48. Branching from the base 44 at the narrow portion 50 is an appendage 52 which defines a slot 53 with the base portion 44. The bottom of the base portion 44 is an enlargement 54 which is received in a matching receptacle 56 provided in the glazing bar section 40. The enlarged portion 54 is entrapped in the receptacle 56 by means of two flanges 58 and 60. Thus it will appear that the glazing gasket is slid longitudinally into the receptacle 56 within which the enlarged portion 53 is retained due to the blocking action of flanges 58 and 60.

The structural portion of the glazing bar and glazing seal arrangement illustrated in FIGS. 2–4 is one-half of a total construction, the other half of which is completed generally by a mirror image of the illustrated portions and parts. This will be explained in greater detail hereinbelow. The glazing bar section 40 is a longitudinally extended part fabricated of a rigid material such as an aluminum extrusion. The glazing seal or gasket 42 is a relatively resilient part fabricated for example of neoprene rubber or the like. The material, for example, of the gasket of the invention may be a 40 pound density closed-cell neoprene sponge material having a 70 durometer. Harder and less resilient materials may also be employed in accordance with the invention. In any event, commercially available materials may be employed and consequently further discussion of these materials is not warranted within the scope of the present text.

The glazing bar section 40 comprises a web 70 from which extend flanges 72 and 74. In the flange 72 is provided a receptacle or track 76 having a narrow throat 78. Both the receptacle 76 and the throat 78 constitute a channel running all or at least substantially all throughout the entire longitudinal extent of the section 40 in order to accommodate the bulbous periphery 80 of a shade 82 peripherally engaged in the channel for being drawn therealong in order to provide for intercepting solar radiation passing through the associated glazing. The glazing bar section 40 moreover comprises a receptacle or track 84 for purposes of accommodating an additional gasket as will become more apparent hereinbelow.

Extending upwardly along the longitudinal extent of the glazing bar section 40 is an extension 90 having a terminal portion 92 accommodated in the slot 53 defined in the glazing gasket section 42. Thus, between the action of the extension 92 which is accommodated in the slot 54 and the enlargement 54 which is accommodated in the receptacle 56, the gasket strip is given a solid connection with and support by the associated glazing bar section.

FIG. 3 illustrates how the transverse part of the glazing gasket is removed selectively to a plurality of positions illustrated at A, B and C. When withdrawn to the position shown at C in FIG. 3 or into the position illustrated in FIG. 4, the glazing gasket admits of the positioning of a glazing panel GP which is inserted into position in the direction illustrated by the arrow 96. Thereafter release of the portion 48 permits the same to move into its relaxed position generally illustrated in FIG. 2 but limited so that the ribbed face 98 moves against the glazing. The ribbed face 98 is a lateral face on the part 48 which is intended to engage against the associated panel section and to exert pressure thereagainst to form a water-tight seal. Thus, part 48 constitutes an entrapment part which mechanically holds the glazing panel in position, thereby to resist forces tending to remove the same as might be caused by high wind velocities or engagement by mechanical parts or the like.

The ribbed face 100*a* is such that pressure against the same generally in the direction shown by arrow 102 will cause a pivotting of the part 48 in clockwise direction as shown by arrow 104, thereby to urge the face 98 with increasing pressure against the associated panel as will be shown. How pressure is exerted against the face 100 appears more precisely and by way of example in FIG. 5 wherein are shown two glass panels GP1 and GP2. In this figure are shown mirror image reproductions of the structure illustrated in FIGS. 2–4 showing how the same cooperate with one another to derive the benefits of the invention as has been generally indicated hereinabove. The same reference numerals as have been employed in FIGS. 2–4 are employed in FIG. 5 with the exception that they are legended a and b to provide for the complementary sections. Thus, faces are indicated at 100*a* and 100*b* (which abut along plane 100), thereby to show that these faces come into mutually abutting relationship along a plane indicated at 100, thereby to force the faces 98*a* and *b* (glazing contact faces or portions) against the outer surfaces 112*a* and *b* of the respective glazing panels.

Sections 40*a* and 40*b* are connected together by a fastening device indicated at 114. This fastening device consists of a bolt 116 having a threaded end 118 engaged by a nut 120. At the opposite end of the bolt 116 is a hexagonal head 122. The nut 120 threadably engages the section 118, thereby drawing the complementary glazing bar sections together along the plane 110.

From what has been indicated above, it will appear that the invention involves a method of mounting glazing in a solarium. This method comprises supporting the glazing against a glazing bar to define an inner solarium space such as indicated at 16. The glazing is clamped to the glazing bar with a such as, for example, an aluminum extrusion. When member 224 gasket of the abovenoted type. Thereafter, a force is applied to the glazing bar within the space 16. This force is a force generated by threading the nut 120 on the threaded section 118 of the bolt 116. Since the faces 110*a* and 110*b* of the glazing gasket are brought into mutually abutting relationship, a part of this force may be regarded as being diverted. This diverted force tends to pivot the upper portions of the glazing gaskets about the narrow portions 50*a* and 50*b*. This forces the gasket at faces 98*a* and 98*b* more tightly against the glazing thereby to lock the same into position. As noted, this involves forming the glazing bar in complementary sections and fastening the sections together with a force exerted through the above-noted bolt. It also involves clamping the glazing to the glazing bar with a force derived from the force used to fasten the glazing bar sections together.

Figure 5:
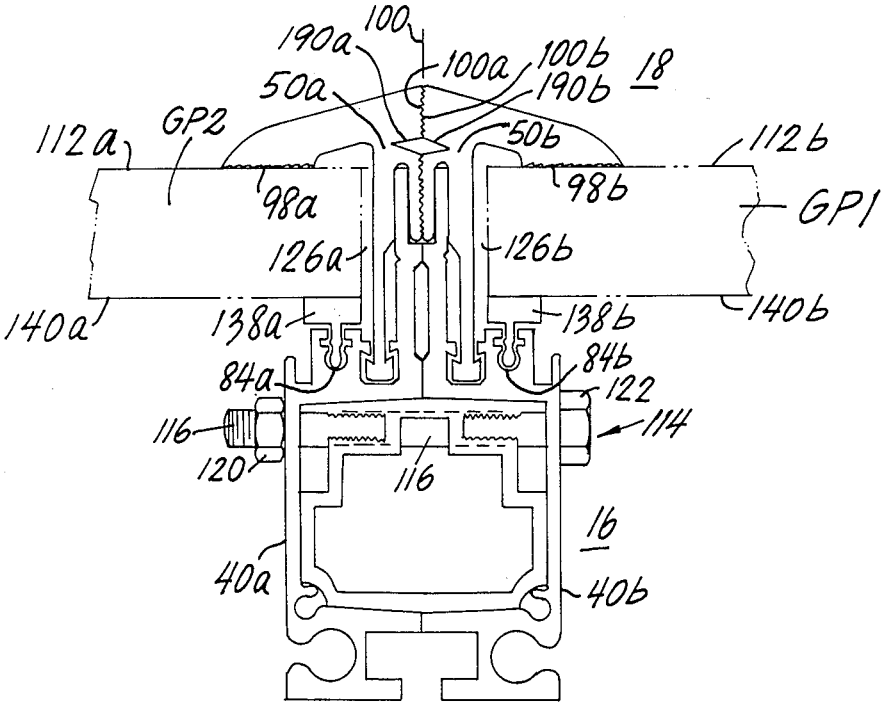
FIG. 5 illustrates an assembled glazing bar employing two glazing gasket strips provided in accordance with the invention.

In the illustration of FIG. 5, it will be noted that additional glazing strips or shoulders may be employed. These are indicated at, 138*a* and 138*b*. These strips have projections which are accommodated in channels 84A and 84B. Consequently, these glazing strips are also slid longitudinally into position and are locked to the associated glazing bar sections. These glazing gasket strips engage against the inner faces 140*a* and 140*b* of the respective glazing panels.

Figure 7:
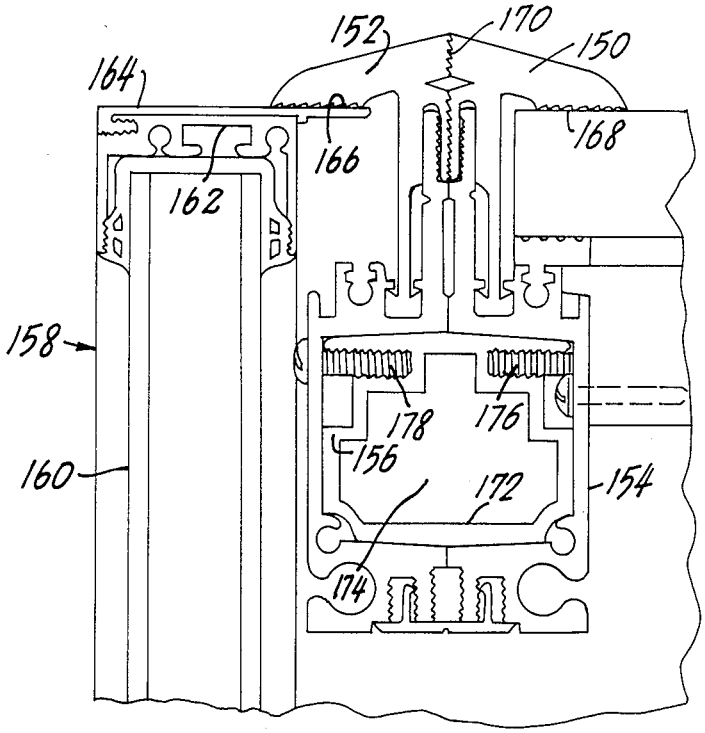
FIG. 7 illustrates a modified utilization of the glazing support construction provided in accordance with the invention.

The structures which have been illustrated above are related to connecting modules together in a manner illustrated in FIG. 1 whereby glazing panels exist on both sides of a glazing bar such as, for example, the glazing bar 24. It will be noted that a glazing bar, such as glazing bar 22, may be the end glazing bar which provides for a gable end construction. Such a construction is shown in detail in FIG. 7 wherein appear glazing gaskets 150 and 152 arranged in the manner indicated above to cooperate with glazing bar sections 154 and 156. In FIG. 7, the gable end is indicated at 158. It comprises glazing 160 mounted in position and provided with an end cap indicated at 162. This end cap includes an outer member 164 against which engages the face 166 of gasket strip 152. The same type of engagement, but against a glass panel, is indicated at 168. The glazing strips may contact along the plane indicated at 170 to operate in the manner which has been indicated above, whereby the gasket strips are forced tightly against the members against which they are brought with a force created by connecting the glazing bar sections together. In the structure illustrated in FIG. 7, there is an interior member 172 mounted in the chamber 174 defined by the glazing bar sections. This interior member is threadably engaged by bolts 176 and 178 to cause the glazing gasket engagement which has been mentioned hereinabove.

Along with the features of the invention mentioned hereinabove are the V-shaped grooves 190*a* and 190*b* (see FIG. 5) which facilitates pivotal movement of the upper gasket sections around the base portions. These V-shaped grooves moreover provide for the withdrawal of the extremities of the glazing gaskets of the invention as, for example, appears in FIG. 4. Another feature of the invention involves the consideration that once the gaskets are in place, it is relatively difficult to remove the glazing panels since they are held in position with a rather rigorous force. In order to enable the withdrawal of the glass panels, the glazing seals may be configured as illustrated in FIG. 6.

Figure 6:
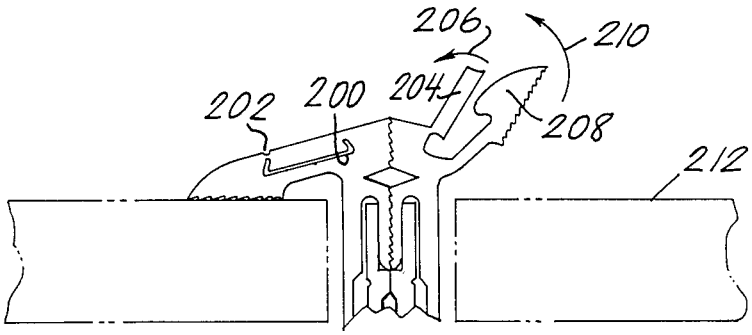
FIG. 6 illustrates a modification of the glazing gasket strips illustrated in FIGS. 2–5 and the utilization of the same to provide for a subsequent release of a glazing panel as may be necessary.

In FIG. 6 is shown an integral slot 200 associated with an exterior groove 202 into which a cutting tool may be inserted. This permits the hinging of portion 204 as shown by arrow 206 to permit a withdrawal of end portion 208 as shown by arrow 210, thereby to permit the freeing and removal of the glass panel as, for example, indicated at 212.

There are different wasy to view the invention. It may be regarded as part of a solarium construction (solarium in this text is taken to mean the same as greenhouse). The solarium construction of the invention defines an inner space separated from ambient atmosphere by glazing. It may be regarded as comprising a framework including glazing bars such as bars 22, 24, 26, 28 and 30 of FIG. 1. Glazing sections are supported on these bars. An arrangement is provided on the bars at least in part externally of the glazing to trap the glazing against the bars and an arrangement is provided inside of the construction which is operatively associated with the bars to tighten the glazing gasket against the glazing as aforesaid. This is more particularly arranged by forming glazing bars of complementary sections which are drawn together with a force which is diverted by interfering sections of the associated glazing gaskets to cause the same to pivot and be brought more tightly against the associated glazing panels.

Figure 8:
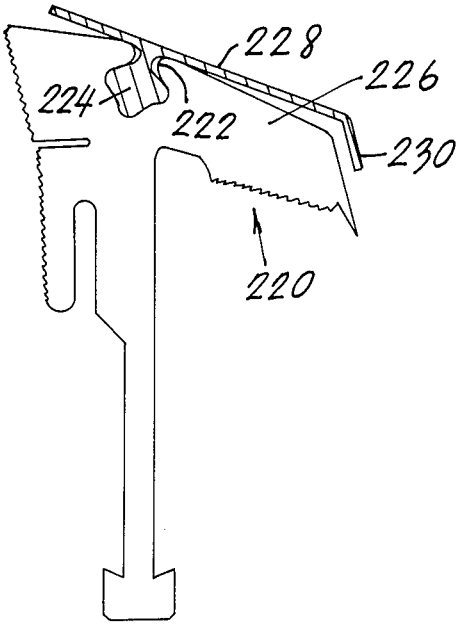
FIG. 8 illustrates a variation of the modification of FIG. 6.

In FIG. 8 is illustrated a variation of FIG. 6 which is basically installed as shown in FIG. 2. In FIG. 8 is more particularly shown a gasket 220 capable of coacting with a mirror-image gasket in the manner described hereinabove. This embodiment of the invention also includes provisions to enable a freeing of the mounted glazing as was described with reference to FIG. 6.

To enable the freeing of glazing, the gasket 220 is provided with a socket 222 in the form of an elongated slot having the cross-section of, for example, a three-leaf clover. This socket accommodates an insert member 224 of like cross-sectional configuration which is also elongated. The elongated socket or slot and member 224 extend longitudinally along portion 226 with the member 224 extending into and filling socket 222. Member 224 is furthermore connected to a cap 228 which is essentially a flat strip having an angularly disposed flange 230. Member 224, cap 228, and flange 230 are preferably of a monolithic rigid structure such as, for example, an aluminum extrusion. When member 224 is in socket 222, portion 226 is relatively rigid and acts in the manner described hereinabove for holding the associated glazing in position. When it is desired to remove the glazing for whatever reason, member 224 is removed and the portion 226 is then free to develop a hinging action in the vicinity of socket 222. Portion 226 can then be turned up and the associated glazing removed.

There will now be obvious to those skilled in the art many modifications and variations of the constructions and methods set forth hereinabove. These modifications and variations will not depart from the scope of the invention if defined by the following claims:

What is claimed is:

1. A glazing structure comprising first and second glazing support means adapted for being brought together to constitute a glazing support, first and second glazing entrapment means mounted respectively on said first and second support means and defining therewith first and second glazing receptacles, first and second glazing members adapted for edgewise engagement in said first and second receptacles, and fastening means to hold the first and second support means together, said first and second entrapment means including respective displaceable glazing contact portions and mutually engageable portions which contact each other as the first and second support means are brought together, the glazing contact portions being forced against respective of the glazing members in response to mutual engagement of the mutually engageable portions to lock the glazing members in the receptacles.

2. A glazing structure as claimed in claim 1 wherein said first and second glazing support means are adapted to abut along a plane, said mutually engageable portions tending to extend across said plane but being positioned to engage one another and thereby be displaced.

3. A glazing structure as claimed in claim 1 wherein the entrapment means are of a relatively resilient material and the support means are of a relatively rigid material.

4. A glazing structure as claimed in claim 1 wherein the support means and entrapment means are longitudinally extended members.

5. A glazing structure as claimed in claim 1 wherein the glazing members define an inner space separated by the glazing members from ambient atmosphere and wherein the fastening means is located in the inner space and the glazing contact portions are located in the ambient atmosphere.

6. A glazing structure as claimed in claim 1 wherein the glazing entrapment means include removable sections to enable a weakening of pressure exerted by the glazing contact portions against the glazing members to permit removal of the glazing members.

7. A glazing structure as claimed in claim 1 wherein the glazing entrapment means include base portions supporting the glazing contact portions and mutually engageable portions, said base portions and glazing support means respectively including and being provided with matching and interengaged enlarged portions and receptacles.

8. A glazing structure as claimed in claim 7 wherein said base portions are further provided with respective slots and the glazing support means include extensions extending into said slots.

9. A glazing structure as claimed in claim 7 wherein the glazing entrapment means are provided with grooves between the base portions and the mutually engageable portions to enable the latter to pivot on the base portions.

10. A glazing structure as claimed in claim 2 wherein the mutually engageable portions are angularly related to said plane and to each other.

11. A glazing structure as claimed in claim 5 wherein the fastening means include a nut and bolt arrangement, the bolt extending through the glazing support means and being engaged by the nut.

12. A glazing structure as claimed in claim 1 wherein the support means are provided with tracks adapted for the peripheral engagement of shades.

13. A glazing structure as claimed in claim 1 wherein the support means include shoulders opposing the glazing contact portions to receive the glazing members therebetween.

14. A solarium construction defining an inner space separated from ambient atmosphere and comprising a framework including glazing bars, glazing sections supported on said bars, first means on said bars at least in part externally of the glazing to trap the glazing against the bars, and second means inside of said construction and operatively associated with said bars to tighten the first means against the glazing.

15. A solarium construction as claimed in claim 14 wherein at least one of said bars includes complementary sections and said second means fastens the complementary sections together, said first means being responsive to the fastening of the complementary sections for being tightened against the glazing.

16. A solarium construction as claimed in claim 15 wherein said first means includes complementary sections in partially abutting relation constituting a water proof seal between adjacent glazing sections.

17. A solarium construction as claimed in claim 16 wherein the complementary sections of the first means are vertically arranged strips.

18. A solarium construction as claimed in claim 17 wherein the glazing, bars and vertically arranged strips include aligned curved sections.

19. A glazing gasket comprising first and second angularly related sections cooperatively including a narrow connecting section at which the second section is pivotal on said first section, said second including first and second parts protruding in opposite directions generally transversely of said first section, said first part having a ribbed end face remote from said narrow section, said second part having a ribbed lateral face adapted to engage against the glazing.

20. A glazing gasket as claimed in claim 19 wherein said sections constitute a monolithic resilient strip provided with a V-shaped groove adjacent said narrow section to enhance the pivot relation between said sections.

21. A glazing gasket as claimed in claim 20 wherein said first section includes an enlarged base adapted to be engaged in a receptacle in a supporting structure and an appendage defining a slot adapted to receive a section of the supporting structure.

22. A method of mounting glazing in a solarium comprising supporting the glazing against a glazing bar to define an inner solarium space, clamping the glazing to the glazing bar with a gasket, applying a force to the glazing bar within the inner space, and diverting at least part of the force to the gasket to force the gasket more tightly against the glazing.

23. A method as claimed in claim 22 comprising forming the glazing bar in complementary sections and fastening the sections together with said force.

24. A method as claimed in claim 23 comprising clamping the glazing to the glazing bar with a force derived from the force used to fasten said sections together.

25. A glazing structure as claimed in claim 1 wherein the glazing entrapment means is provided with a socket, comprising a rigid insert removably located in said socket.

26. A glazing structure as claimed in claim 25 comprising a cap on said insert and overlying the glazing entrapment means.

* * * * *